US009705267B2

(12) United States Patent
Cheng et al.

(10) Patent No.: US 9,705,267 B2
(45) Date of Patent: Jul. 11, 2017

(54) ELECTRICAL CONNECTOR WITH GROUNDING PLATE RETAINED THEREIN

(71) Applicant: FOXCONN INTERCONNECT TECHNOLOGY LIMITED, Grand Cayman (KY)

(72) Inventors: Chih-Pi Cheng, New Taipei (TW); Ming-Lun Szu, New Taipei (TW); Chao-Chieh Chen, New Taipei (TW); Chih-Kai Yang, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/011,687

(22) Filed: Feb. 1, 2016

(65) Prior Publication Data

US 2016/0233630 A1 Aug. 11, 2016

(30) Foreign Application Priority Data

Feb. 9, 2015 (CN) ..... 2015 2 0086514 U

(51) Int. Cl.

| | |
|---|---|
| ***H01R 24/60*** | (2011.01) |
| ***H01R 12/72*** | (2011.01) |
| ***H01R 13/6594*** | (2011.01) |
| *H01R 107/00* | (2006.01) |

(52) U.S. Cl.

CPC ..... *H01R 24/60* (2013.01); *H01R 12/722* (2013.01); *H01R 13/6594* (2013.01); *H01R 2107/00* (2013.01)

(58) Field of Classification Search

USPC ..... 439/350, 352, 607.32, 607.23, 607.11

See application file for complete search history.

(56) References Cited

U.S. PATENT DOCUMENTS

| | | | | |
|---|---|---|---|---|
| 5,073,130 | A * | 12/1991 | Nakamura | H01R 13/65802 439/607.32 |
| 7,758,379 | B2 * | 7/2010 | Chen | H01R 13/6485 439/607.11 |
| 8,851,927 | B2 * | 10/2014 | Hsu | H01R 12/724 439/607.11 |
| 9,022,800 | B2 * | 5/2015 | Yang | H01R 13/6581 439/487 |

(Continued)

FOREIGN PATENT DOCUMENTS

CN 203942066 U 11/2014

*Primary Examiner* — Alexander Gilman

(74) *Attorney, Agent, or Firm* — Wei Te Chung; Ming Chieh Chang

(57) ABSTRACT

An electrical connector includes a terminal module unit with contacts and grounding plates thereof. The terminal module includes an insulative base and an insulative mating tongue forwardly extending therefrom. The mating tongue forms opposite mating surfaces. The contacts includes the contacting sections on the mating surfaces and the connecting legs. The mating tongue includes a root section adjacent to the base. The grounding plates unit covers the root section in an embedded manner. The grounding plate includes a planar body exposed upon the mating surface, and a pair of fixing side arms extending from two opposite ends of the planar body and equipped with corresponding latching hooks to secure to the semi-finished root section before the final insert-molding process is applied.

19 Claims, 13 Drawing Sheets

(56) References Cited

U.S. PATENT DOCUMENTS

| | | | | |
|---|---|---|---|---|
| 9,106,024 | B2 * | 8/2015 | Zhao | H01R 13/6594 |
| 9,209,573 | B1 * | 12/2015 | Chen | H01R 13/6581 |
| 9,276,365 | B2 * | 3/2016 | Yu | H01R 24/70 |
| 9,281,629 | B2 * | 3/2016 | Little | H01R 13/6583 |
| 9,281,642 | B1 * | 3/2016 | Tseng | H01R 24/60 |
| 9,281,643 | B1 * | 3/2016 | Tseng | H01R 13/518 |
| 9,306,336 | B2 * | 4/2016 | Chang | H01R 13/6471 |
| 9,306,337 | B2 * | 4/2016 | Yu | H01R 24/60 |
| 9,356,406 | B2 * | 5/2016 | Yen | H01R 13/6581 |
| 9,379,494 | B1 * | 6/2016 | Hu | H01R 13/6594 |
| 9,385,484 | B2 * | 7/2016 | Chen | H01R 13/6582 |
| 9,461,412 | B2 * | 10/2016 | Yu | H01R 13/6585 |
| 9,461,413 | B2 * | 10/2016 | Duan | H01R 13/6594 |
| 9,461,415 | B2 * | 10/2016 | Guo | H01R 13/41 |
| 9,466,924 | B2 * | 10/2016 | Lin | H01R 13/6585 |
| 9,466,930 | B2 * | 10/2016 | Little | H01R 24/60 |
| 2009/0163071 | A1 * | 6/2009 | Chen | H01R 13/65802 439/352 |
| 2010/0267261 | A1 * | 10/2010 | Lin | H01R 13/6461 439/218 |
| 2014/0099835 | A1 * | 4/2014 | Chang | H01R 13/6581 439/682 |
| 2015/0244111 | A1 * | 8/2015 | Ju | H01R 13/6585 439/607.05 |

* cited by examiner

ELECTRICAL CONNECTOR WITH GROUNDING PLATE RETAINED THEREIN

BACKGROUND OF THE INVENTION

1. Field of the Invention

The present invention relates to an electrical connector, and particularly to the electrical connector having grounding plates with latching hooks to be pre-assembled with the terminal module before the final insert-molding process for forming the complete product.

2. Description of Related Art

The Chinese Utility Patent No. CN203942066 U discloses a receptacle connector and a plug connector with dual orientations mating, wherein the receptacle connector forms firstly the upper terminal module via a first step insert-molding process and the lower terminal module as well, and further sandwich a shielding plate therebetween to apply a second step insert-molding process for forming a final molded part. Lastly, a pair of grounding plates are assembled upon the insulative housing to finalize the terminal module. Notably, one potential problem is regarding the rigidity of the whole connector. Also, the ground plates successively assembled upon the terminal module after the terminal module is insert-molded, may affect the appearance of the terminal module.

Hence, an electrical connector including an improved structure is necessary.

SUMMARY OF THE INVENTION

Accordingly, an object of the present invention is to provide an electrical connector overcoming the aforementioned shortcomings, and method of making the same with the improved structure.

To achieve the above object, an electrical connector includes a terminal module unit with contacts and grounding plates thereof. The terminal module unit includes an insulative base and an insulative mating tongue forwardly extending therefrom. The mating tongue forms opposite mating surfaces. The contacts includes the contacting sections on the mating surfaces and the connecting legs. The mating tongue includes a root section adjacent to the base. The grounding plate unit covers the root section in an embedded manner. The grounding plate includes a planar body exposed upon the mating surface, and a pair of fixing side arms extending from two opposite ends of the planar body and equipped with corresponding latching hooks to secure to the semi-finished root section before the final insert-molding process is applied. Compared with the prior method, the latching hooks of the grounding plates may reliably secure the grounding plates in position during the final/second step insert-molding process, thus avoiding improper displacement of the grounding plates with regard to the semi-finished root section and assuring the true position of the final product.

Other objects, advantages and novel features of the invention will become more apparent from the following detailed description when taken in conjunction with the accompanying drawings.

DETAILED DESCRIPTION OF THE PREFERRED EMBODIMENT

Figure 1:
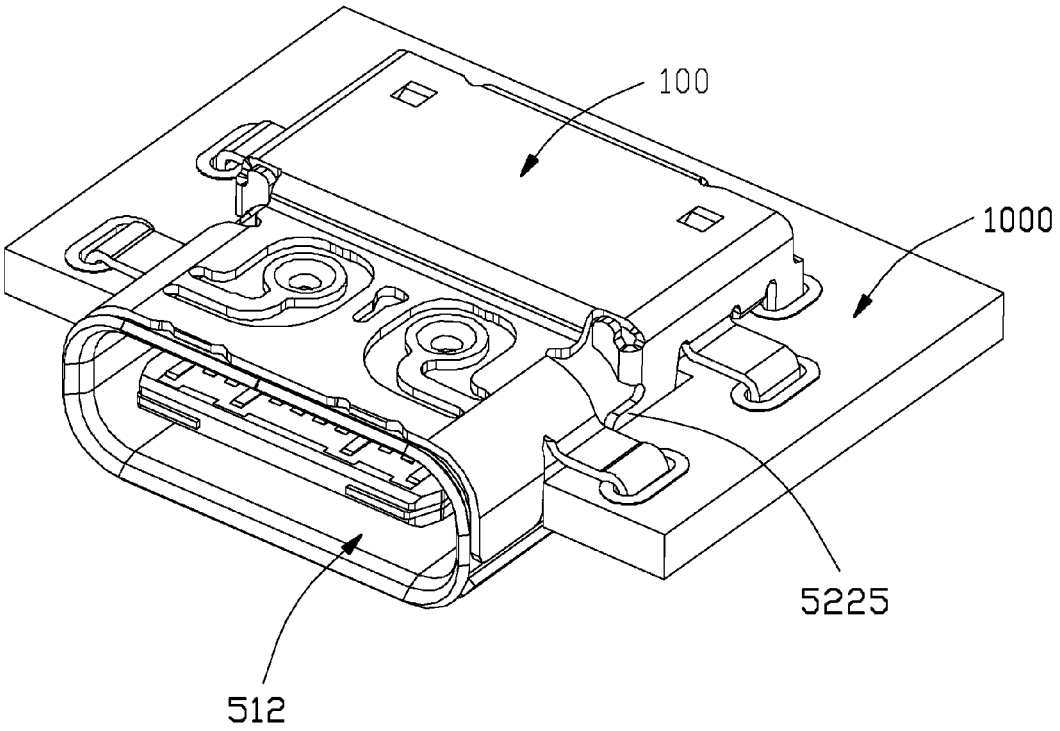
FIG. 1 is a perspective view of the electrical connector mounted upon the printed circuit board, according to a first embodiment of the invention.
Figure 2:
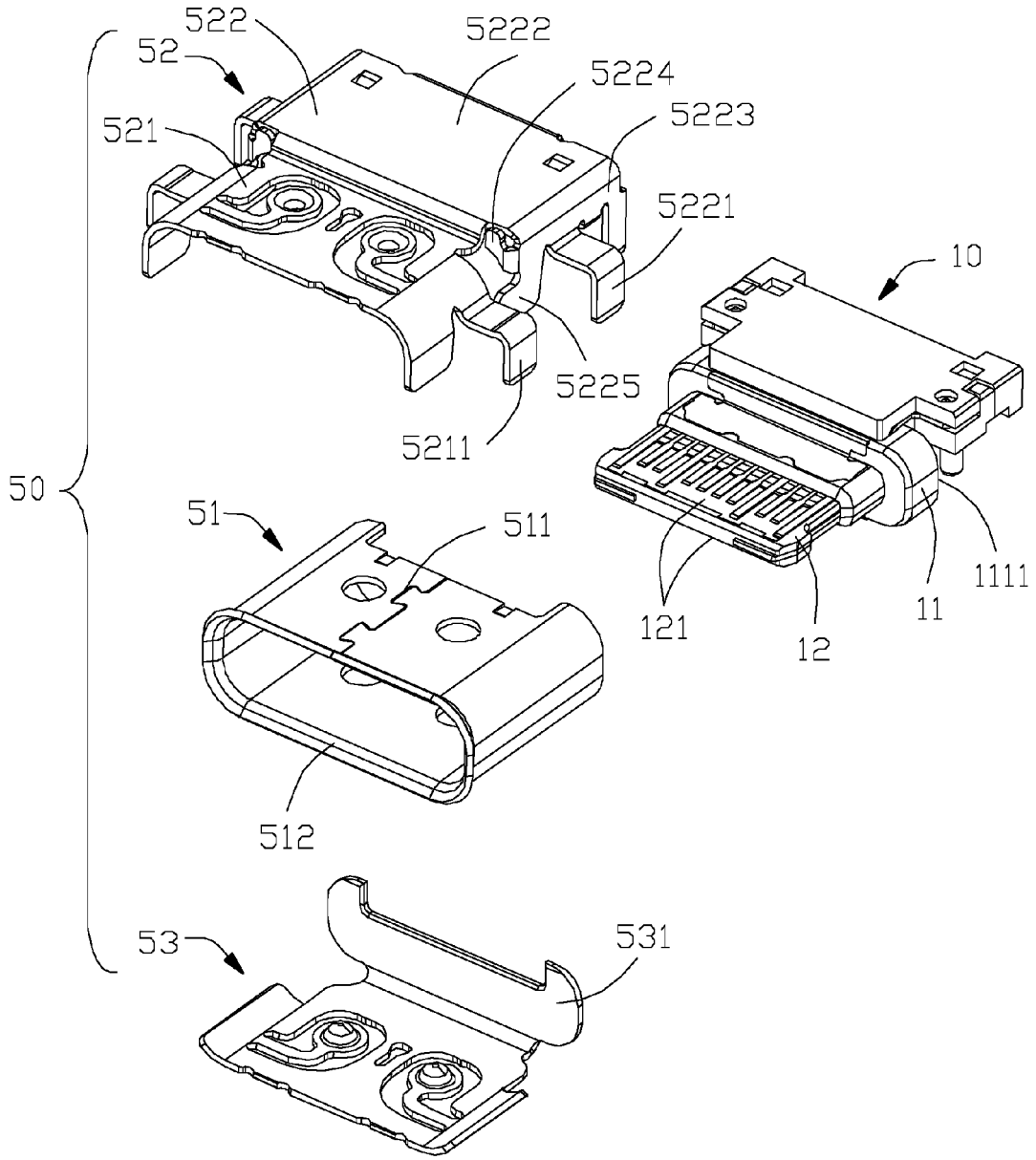
FIG. 2 is a perspective view of the electrical connector in FIG. 1.
Figure 3:
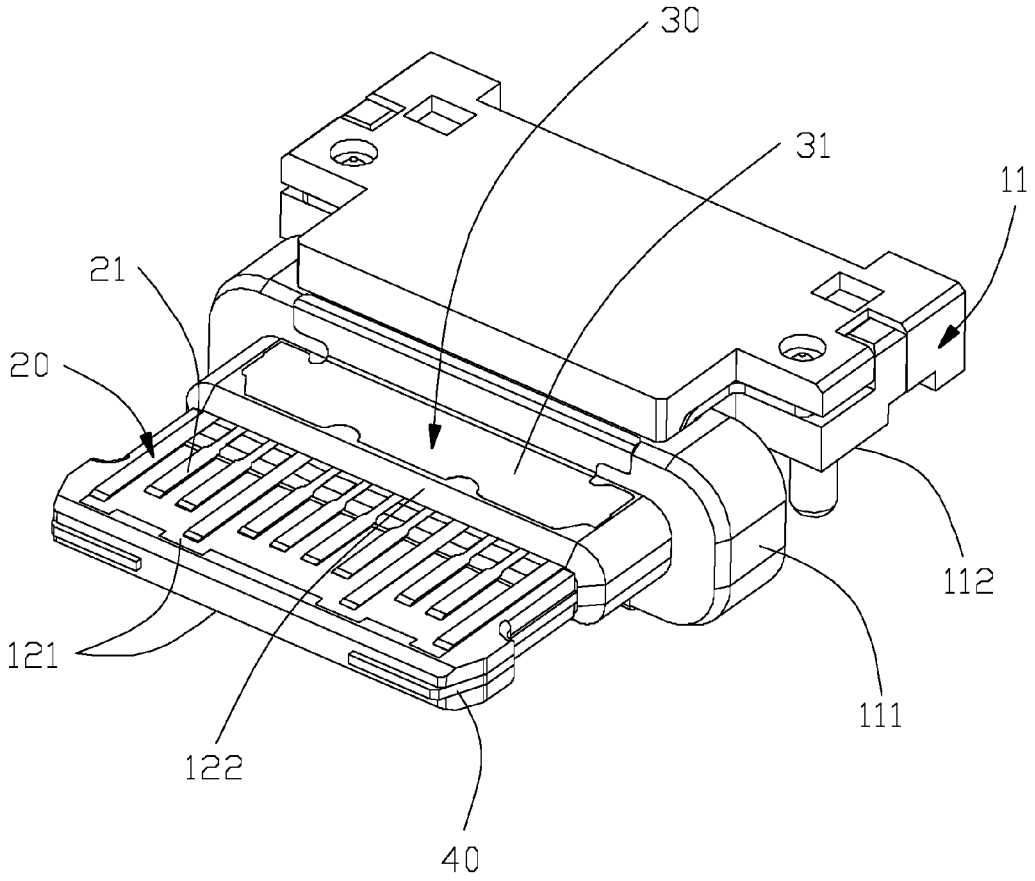
FIG. 3 is a perspective view of the complete terminal module of the electrical connector in FIG. 1.
Figure 4:
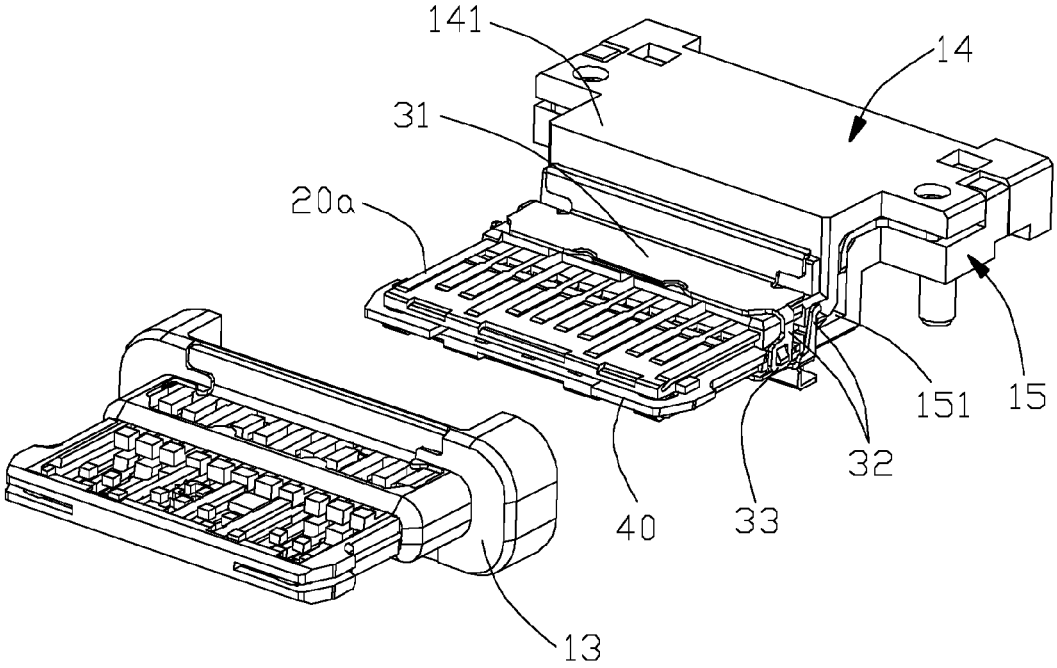
FIG. 4 is a perspective view of the terminal module in FIG. 3 wherein the insulator formed in the second step insert-molding process is removed away from the pre-assembled upper terminal module, the lower terminal module, the shielding plate and the grounding plates.
Figure 5:
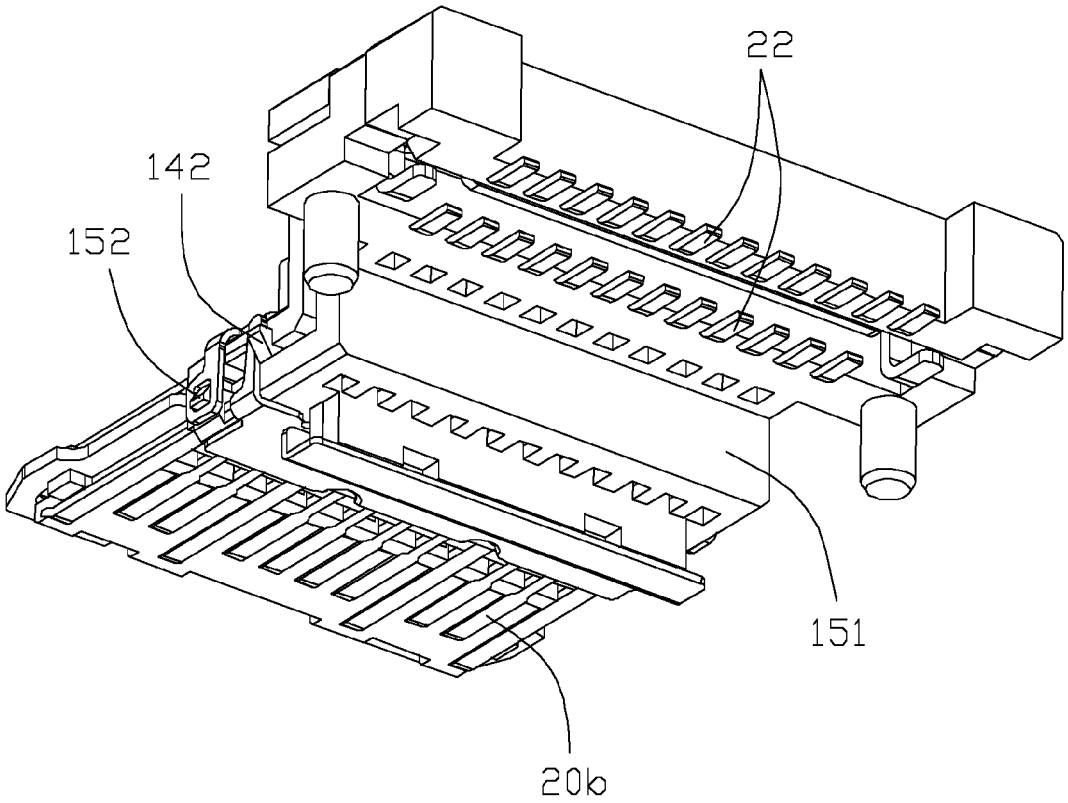
FIG. 5 is another perspective view of the terminal module without the insulator in FIG. 4.
Figure 6:
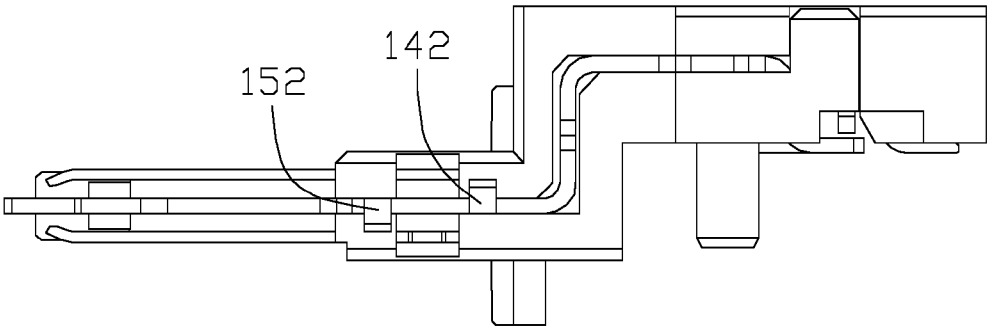
FIG. 6 is a side view of the terminal module in FIG. 5.
Figure 7:
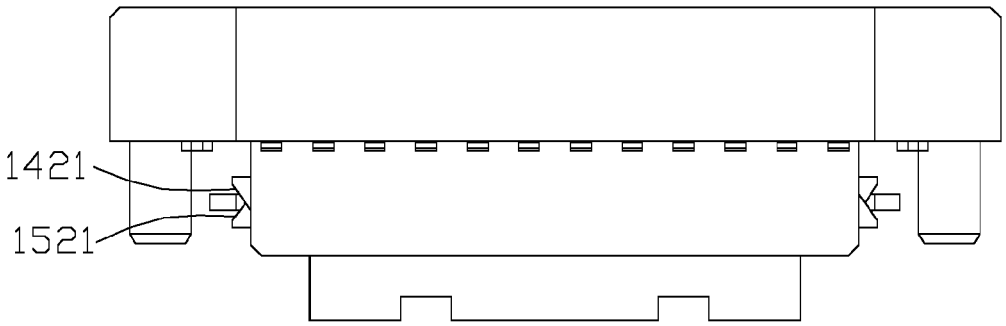
FIG. 7 is a rear view of the terminal module in FIG. 5.
Figure 8:
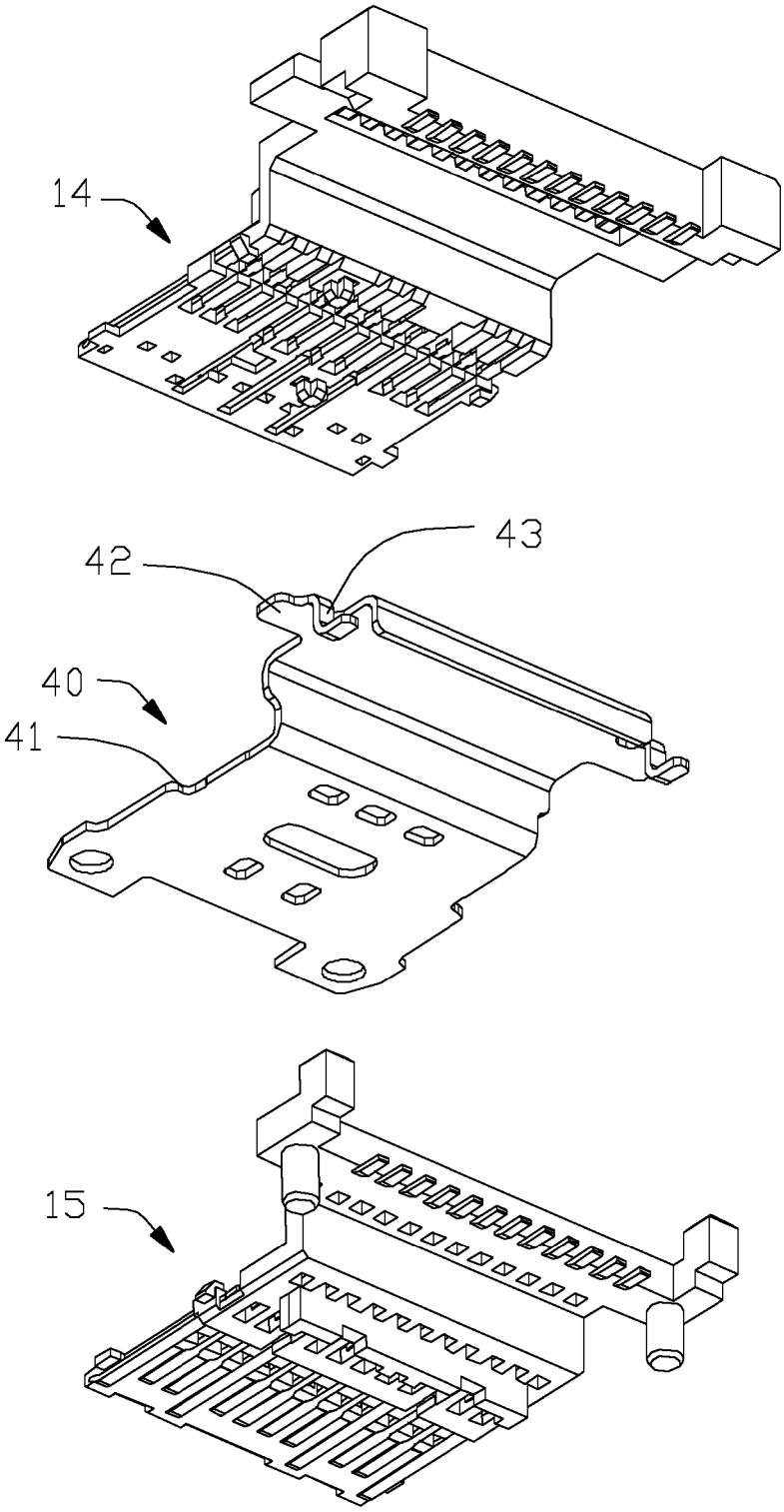
FIG. 8 is an exploded perspective view of the terminal module in FIG. 5.
Figure 9:
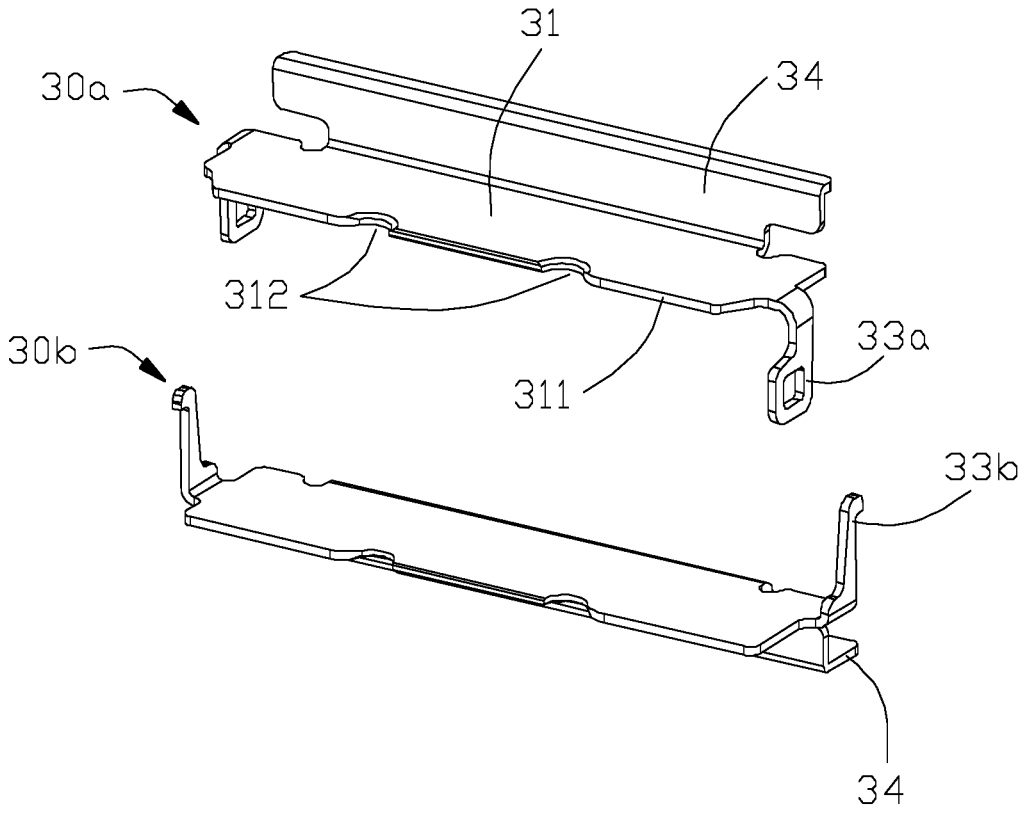
FIG. 9 is a perspective view of the grounding plates in FIG. 5.

Reference will now be made in detail to the preferred embodiment of the present invention.

Referring to FIGS. 1-9, an electrical connector 100 for mounting into a cutout in a printed circuit board 1000 wherein the mating opening 512 is lower than the mounting surface of the printed circuit board 1000. The connector 100 includes a terminal module unit 10 and a metallic shield unit 50. The terminal module unit 10 includes an insulative base 11 and a mating tongue 12 forwardly extending from the base 11. A pair of mating surfaces 121 are formed on the mating tongue 12. The shield unit 50 includes a mating part 51 enclosing the mating tongue 12 to form a mating cavity, and an upper cover 52 with a front cover 521 and a rear cover 522 thereof, and a lower cover 53. The seam 511 of the mating section 51 is located on the upper wall and a front edge is flared to form the mating opening 512. The front cover 521 is positioned upon the upper wall of the mating section 51, the rear cover 522 shields the base 11. The front cover 521 and the rear cover 522 form the mounting legs 5211 and 5221. The rear cover 522 includes a top wall 5222, two side walls 5223, the tags 5224 bent from the side wall 5223, and the extension 5225 extending from the side wall 5223, wherein the tags 5224 covers the corner adjacent to the base 11 and the top wall 5222, and the extension 5225 is soldered to rear region of the mating section 51. The lower cover 53 is soldered to the lower wall of the mating section 51, and further includes a rear wall 531 covering the rear face of the base 11 within the notch and under the printed circuit board 1000. The upper cover 52 covers the rear face of the base 11 above the printed circuit board 1000.

The terminal module unit 10 is equipped with contacts 20, the grounding plates 30 and the shielding plate 40. The contacts 20 include the contacting section 21 exposed upon the mating surfaces 121 and the legs 22. The mating tongue 12 forms a root section 122 adjacent to the base 11. The grounding plate (unit) 30 covers the root section 122 and includes a planar body 31 exposed upon the mating surfaces 121, and a pair of fixing side arms 32 embedded within the root section 122, wherein the fixing side arm 32 further includes a latching hook 33 secured to the terminal module unit 10 before the insulator 13 is injected, via a second step insert-molding process, upon the semi-finished terminal module as shown in FIG. 1, thus assuring the correct position of the grounding plate 30 upon the finalized root section 122. Notably, in the finalized terminal module unit 10 the grounding plates 30 are exposed upon the root section 122 only with the planar body 31 in a smooth manner.

The terminal module unit 10 includes an upper terminal module 14, a lower terminal module 15 and a metallic shielding plate 40 sandwiched therebetween. As noted, similar to the previous designs filed by the same applicant, the upper terminal module 14 and the lower terminal module have corresponding posts and receiving holes for interengagement therebetween to have the upper terminal module and the lower terminal module fixed to each other with the shielding plate 40 sandwiched therebetween for forming a pre-assembled unit before the second step insert-molding process. The upper terminal module 14 includes an upper insulative body 141 and the upper contacts 20*a* embedded therein, the lower terminal module 15 includes a lower insulative body 151 and the lower contacts embedded therein. The grounding plate (unit) 30 include an upper grounding plate 30*a* and a lower grounding plate 30*b*. The lower insulative body 151 forms a lower protrusion 152 for engagement with the latching hook 33*a* of the upper grounding plate 30*a*; the upper insulative body 141 forms an upper protrusion 142 for engagement with the latching hook 33*b*. The upper protrusion 142 forms a downward guiding surface 1421 toward the lower insulative body 151; the lower protrusion 152 forms an upward guiding surface 1521 toward the upper insulative body 142. The upper insulative body 141 and the lower insulative body 151 form minor posts (not clearly shown) on rear sides, corresponding to the notches 312 of the grounding plate 30 (later illustrated) for temporarily holding the grounding plate 30 in position with regard to the upper insulative body 141 and the lower insulative body 151. After the upper terminal module 14 and the lower terminal module 15 and the shielding plate 40 are pre-assembled together, the upper grounding plate 30*a* is positioned upon the upper insulative body 141 with the latching hook 33*a* of the upper grounding plate 30*a* moving along the upward guiding surface 1521 and locked with the lower protrusion 152, and the lower grounding plate 30*b* is positioned upon the lower insulative body 151 with the latching hook 33*b* of the lower grounding plate 30*b* moving along downward guiding surface 1421 and locked with the upper protrusion 142, thus pre-assembling the upper grounding plate 30*a* and the lower grounding plate 30*b* upon the upper insulative body 141 and the lower insulative body 151. In this embodiment, the dimension of the upper protrusion 142 and the lower protrusion 152 is 0.325 mm. The planar body 31 of the grounding plate 30 includes a front edge region 311 with notches 312 which receivably engage the corresponding aforementioned posts (not shown) and are further filled with the insulator 13 so as to retain the grounding plate 30 in position. The grounding plate 30 includes an extending portion 34 abuts against the upper insulative body 141 and the lower insulative body 151. Notably, the fixing side arms 32 do not contact the shielding plate 40 or the contacts 20. Finally, via a second step insert-molding process, the insulator 13 is applied upon the pre-assembled upper terminal module 14, the lower terminal module 15, the shielding plate 40 therebetween, and the upper grounding plate 30*a* attached upon the upper insulative body 141 and the lower grounding plate 30*b* attached upon the lower insulative body 151, including an inside and an outside. Therefore, the complete mating tongue 12 and the vertical section 111 of the base 11 are formed. Notably, the extending portion are embedded within the terminal module unit 10 in a coplanar manner.

The shielding plate 40 is located between the upper contacts 20*a* and the lower contacts 20*b* and includes a locking side edge 41 beyond the mating tongue 12, a pair of lateral sections 42 with mounting legs 43 located by two sides of the legs of the upper contacts 20*a* and the lower contacts 20*b*.

In this embodiment, the latching hook 33*a* of the upper grounding plate 30*a* is an opening within a confined structure while the latching hook 33*b* of the lower grounding plate 30*b* is of an L-shape and the L-shaped latching hooks 33*b* of the lower grounding plate 30*b* are directed in two opposite orientations in the front-to-back direction. On the other hand, the latching hook of the upper grounding plate and the latching hook of the lower grounding plate are directed in two opposite orientations in the front-to-back direction too.

Figure 10:
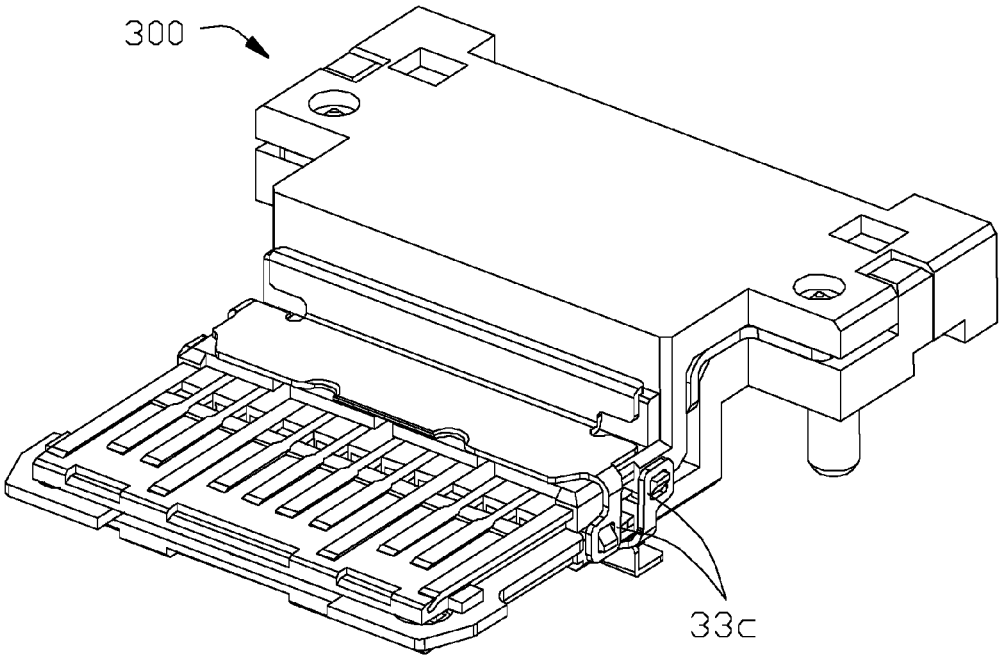
FIG. 10 is a perspective view of the terminal module without the insulator according to a second embodiment of the invention.
Figure 11:
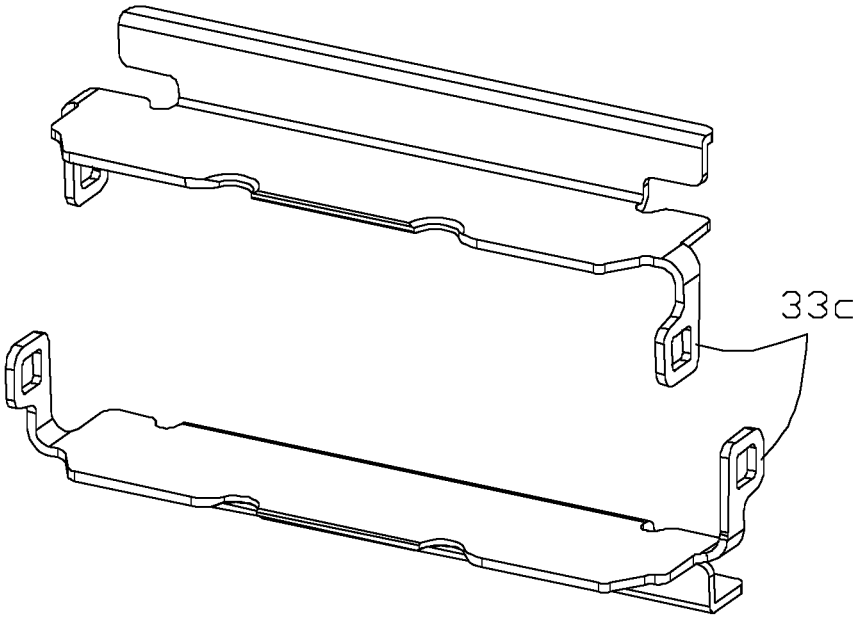
FIG. 11 is a perspective view of the grounding plates in FIG. 10.
Figure 12:
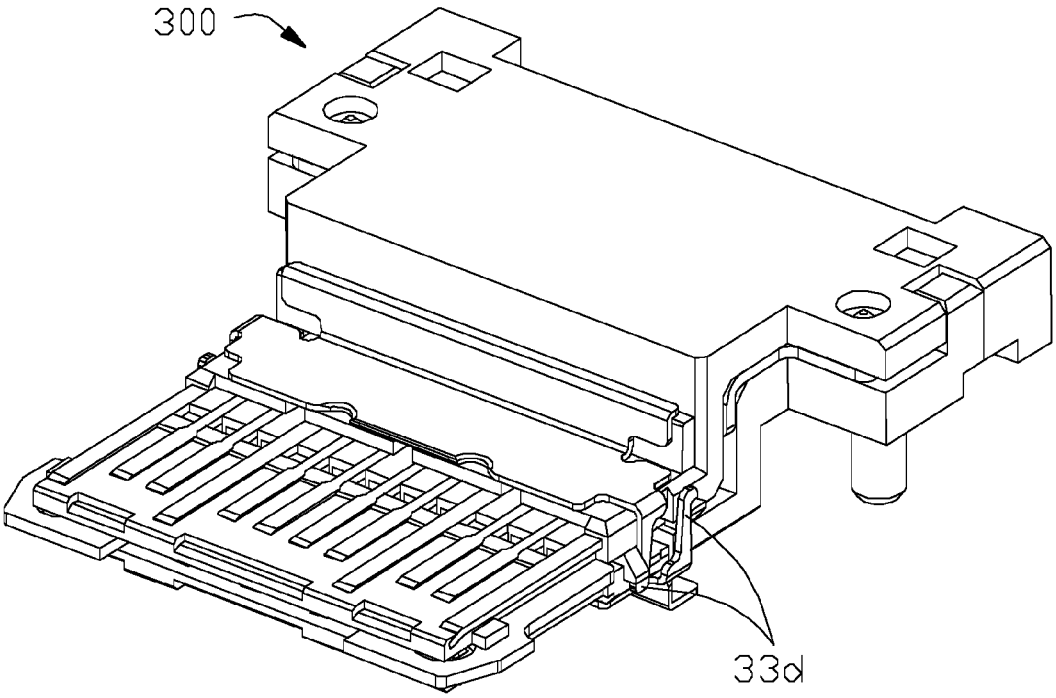
FIG. 12 is a perspective view of the terminal module without the insulator according to a third embodiment of the invention.
Figure 13:
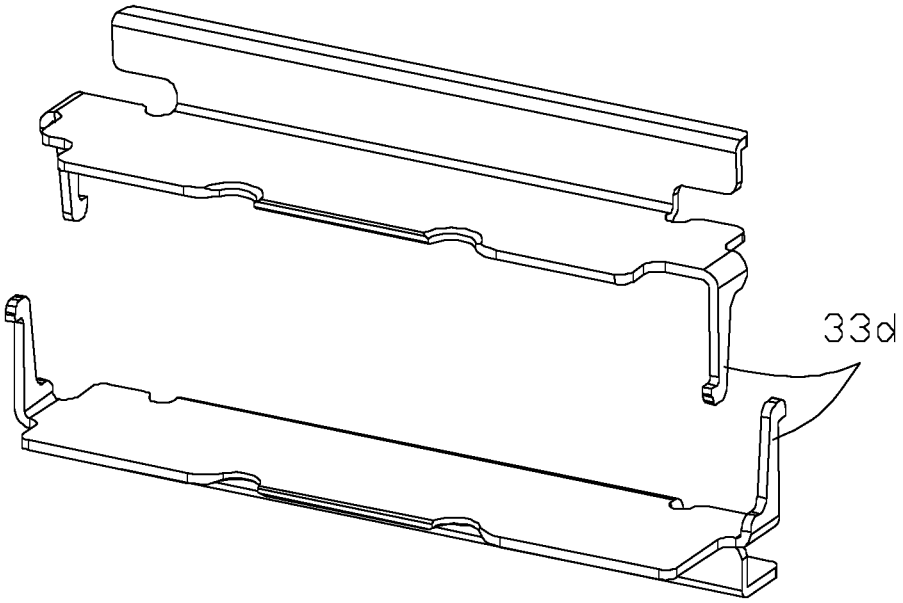
FIG. 13 is a perspective view of the grounding plates in FIG. 12.

FIGS. 10 and 11 disclose a second embodiment including an electrical connector 200 wherein the latching hooks of both the upper grounding plate and the lower grounding plate are similar to the latching hook 33*a* while FIGS. 12 and 13 disclose a third embodiment including an electrical connector 300 wherein the latching hooks of both the upper grounding plate and the lower grounding plate are similar to the latching hook 33*b*. Alternately, the U-shaped latching hook may be used instead.

While a preferred embodiment in accordance with the present invention has been shown and described, equivalent modifications and changes known to persons skilled in the art according to the spirit of the present invention are considered within the scope of the present invention as described in the appended claims. Understandably, the feature of the invention is to provide the temporary retention between the upper/lower grounding plate and the upper/lower insulative body before the second step insert-molding process for resisting the high pressure during injection molding process and assuring the correct position of the upper/lower grounding plate upon the upper/lower insulative body after the second step insert-molding process.

What is claimed is:

1. An electrical connector comprising a terminal module unit enclosed within a metallic shield unit to form a mating cavity to communicate with an exterior along a front-to-back direction;

said terminal module unit including an upper terminal module, a lower terminal module and a metallic shielding plate sandwiched therebetween in a vertical direction perpendicular to said front-to-back direction to form a pre-assembled unit;

the upper terminal module including a plurality of upper contacts retained within an upper insulative body via a first step insert-molding process;

the lower terminal module including a plurality of lower contacts retained within a lower insulative body via another first step insert-molding process;

a grounding plate unit including an upper grounding plate and a lower grounding plate;

the upper grounding plate positioned upon the upper insulative body with latching devices secured to the lower insulative body, and the lower grounding plate positioned upon the lower insulative body with latching devices secured to the upper insulative body for providing retention of the grounding plate unit during a second step insert-molding process wherein an insulator is applied upon the pre-assembled unit during the second step insert-molding process to form a complete terminal module unit including a complete mating tongue thereof.

2. The electrical connector as claimed in claim 1, wherein the shielding plate forms a pair of latching side edges in a transverse direction perpendicular to both said vertical direction and said front-to-back direction.

3. The electrical connector as claimed in claim 2, wherein the latching device is of an L-shape or U-shape.

4. The electrical connector as claimed in claim 2, wherein said latching device is an opening with a confinement structure surrounding said opening.

5. The electrical connector as claimed in claim 2, wherein the latching devices of the upper grounding plate and the latching device of the lower grounding plate are directed in opposite orientations along said front-to-back direction.

6. The electrical connector as claimed in claim 2, wherein the latching devices of each of the upper grounding plate and the lower grounding plate are directed in opposite orientations along said front-to-back direction.

7. The electrical connector as claimed in claim 2, wherein the upper insulative body forms a downward wedged protrusion for guidable engagement with the outwardly deflected corresponding latching device of the lower grounding plate, and the lower insulative body forms an upward wedged protrusion for guidable engagement with the outwardly deflected corresponding latching device of the upper grounding plate.

8. An electrical connector comprising:

a terminal module unit enclosed within a metallic shield unit to form a mating cavity to communicate with an exterior along a first direction;

said terminal module unit including a first terminal module, a second terminal module and a metallic shielding plate sandwiched therebetween in a second direction perpendicular to said first direction to form a pre-assembled unit;

the first terminal module including a plurality of first contacts retained within a first insulative body via a first step insert-molding process;

the second terminal module including a plurality of second contacts retained within a second insulative body via another first step insert-molding process;

a grounding plate unit including an first grounding plate and a second grounding plate;

the first grounding plate positioned upon the first insulative body with at least one latching device secured to the second insulative body, and the second grounding plate positioned upon the second insulative body with at least one latching device secured to the first insulative body for providing retention of the grounding plate unit during a second step insert-molding process wherein an insulator is applied upon the pre-assembled unit during the second step insert-molding process to form a complete terminal module unit including a complete mating tongue thereof.

9. The electrical connector as claimed in claim 8, wherein the shielding plate forms a pair of latching side edges in a transverse direction perpendicular to both said front-to-back direction and said vertical direction.

10. The electrical connector as claimed in claim 9, wherein the latching device is of an L-shape or U-shape.

11. The electrical connector as claimed in claim 9, wherein said latching device is an opening with a confinement structure surrounding said opening.

12. The electrical connector as claimed in claim 9, wherein the latching device of the upper grounding plate and the latching device of the lower grounding plate are directed in opposite orientations along said front-to-back direction.

13. The electrical connector as claimed in claim 9, wherein each of said first grounding plate and said second grounding plate includes at least two latching devices which are directed in opposite orientations along said front-to-back direction.

14. The electrical connector as claimed in claim 9, wherein the upper insulative body forms a downward wedged protrusion for guidable engagement with the laterally deflected latching device of the lower grounding plate, and the lower insulative body forms an upward wedged protrusion for guidable engagement with the laterally deflected latching device of the upper grounding plate.

15. A method of making an electrical connector comprising:

providing a first terminal module including a plurality of first contacts retained in a first insulative body via a first step insert-molding process;

providing a second terminal module including a plurality of second contacts retained in a second insulative body via another first step insert-molding process;

assembling the first terminal module and the second terminal module together with a metallic shielding plate therebetween in a first direction;

assembling a first grounding plate upon the first insulative body with at least one latching device initially retaining to at least one of said first insulative body and said second insulative body;

assembling a second grounding plate upon the second insulative body with at least one latching device initially retaining to at least one of said first insulative body and said second insulative body; and applying an insulator upon a pre-assembled unit including the first terminal module with the first grounding plate thereon, the second terminal module with the second grounding plate thereon, and the shielding plate therebetween, to form a complete terminal module including a complete mating tongue; wherein the latching device is deflectable along said second direction during retaining to at least one of said first insulative body and said second insulative body along said first direction.

16. The method as claimed in claim 15, wherein said shielding plate forms a pair of latching side edges on two opposite lateral sides in said second direction perpendicular to said first direction.

17. The method as claimed in claim 15, further including a step of assembling a metallic shield unit upon the terminal module unit.

18. The method as claimed in claim 15, wherein the latching device of the first grounding plate is retained to the second insulative body, and the latching device of the second grounding plate is retained to the first insulative body.

19. The method as claimed in claim 15, wherein the first grounding plate includes two said latching devices on two lateral sides in said second direction, and the second grounding plate includes two said latching devices on two lateral sides in said second direction.

* * * * *